US007025219B2

(12) United States Patent
Heisner et al.

(10) Patent No.: US 7,025,219 B2
(45) Date of Patent: Apr. 11, 2006

(54) MULTI-PURPOSE GRIPPABLE BELL

(75) Inventors: David B. Heisner, York, PA (US); Justin Howell, Etters, PA (US)

(73) Assignee: Graham Packaging Company, L.P., York, PA (US)

( * ) Notice: Subject to any disclaimer, the term of this patent is extended or adjusted under 35 U.S.C. 154(b) by 218 days.

(21) Appl. No.: 10/697,276

(22) Filed: Oct. 31, 2003

(65) Prior Publication Data

US 2005/0092708 A1 May 5, 2005

(51) Int. Cl.
*B65D 1/02* (2006.01)
*B65D 23/10* (2006.01)

(52) U.S. Cl. ..... 215/384; 215/381; 220/672

(58) Field of Classification Search ..... 215/381, 215/383, 384, 379, 398; 220/771, 666, 669, 220/672, 675

See application file for complete search history.

(56) References Cited

U.S. PATENT DOCUMENTS

| | | | | |
|---|---|---|---|---|
| D320,154 | S * | 9/1991 | Alberghini et al. | D9/520 |
| 5,141,121 | A * | 8/1992 | Brown et al. | 215/381 |
| 5,392,937 | A | 2/1995 | Prevot et al. | |
| 5,598,941 | A | 2/1997 | Semersky et al. | |
| D398,538 | S * | 9/1998 | Fuquen et al. | D9/542 |
| D421,720 | S * | 3/2000 | Eberle et al. | D9/500 |
| 6,044,997 | A | 4/2000 | Ogg | |
| 6,161,713 | A * | 12/2000 | Krich | 215/384 |
| D445,695 | S * | 7/2001 | Ogg | D9/550 |
| 6,273,282 | B1 * | 8/2001 | Ogg et al. | 215/381 |
| D447,411 | S | 9/2001 | Lichtman | |
| 6,662,960 | B1 * | 12/2003 | Hong et al. | 215/381 |
| D487,228 | S * | 3/2004 | Heisner et al. | D9/538 |

FOREIGN PATENT DOCUMENTS

| | | |
|---|---|---|
| JP | 07-76333 | 3/1995 |
| JP | 2002-293316 | 10/2002 |
| JP | 2002283441 | 10/2002 |
| WO | WO 02/057146 A | 7/2002 |

* cited by examiner

*Primary Examiner*—Sue A. Weaver
(74) *Attorney, Agent, or Firm*—Venable, LLP; James R. Burdett; Keith G. Haddaway

(57) ABSTRACT

A dome for a plastic container having a longitudinal axis, including an upper portion with a flanged finish adapted to receive a cap where the upper portion extends substantially annular about the axis from the flanged finish to a first horizontal rib, an intermediate portion extending outwardly from under the first horizontal rib of the upper portion to a second horizontal rib, a lower portion extending outwardly from under the second horizontal rib to a third horizontal rib where the third horizontal rib being substantially annular; and a grip panel formed in opposite side surfaces from under the first horizontal rib to above the third horizontal rib, where the opposing grip panels enable a thumb and forefingers of an hand size to grip the container while opposing surfaces of the intermediate and lower portions without the grip panel enable a thumb and forefingers of another hand size to grip the container.

23 Claims, 7 Drawing Sheets

MULTI-PURPOSE GRIPPABLE BELL

BACKGROUND OF THE INVENTION

1. Field of the Invention

The present invention relates generally to a top portion of a container designed with a multi-purpose grip, which increases the ability of a person (a customer) to grip the container by providing multiple gripping options, and more particularly to a tiered bell-shaped top portion of container designed to accommodate grips of various hand sizes, or, different sized grips for a single hand that may hold the container more securely or be more comfortable to the person.

2. Related Art

As explained in the Assignee's U.S. Pat. No. 6,044,997 to Ogg, the upper portion or dome of a container has been generally characterized by a circular cross-section with a waist. Some people have been known to use the waist to grip the container for pouring with one hand, but this is not satisfactory in large containers because the waist is too large to be securely gripped by a number of customers desiring to pour out the contents of the container. While Ogg mentions that a stepped dome would be easier to grip, Ogg dismisses this concept because a stepped dome would not facilitate the pouring of contents from the container.

Another container by the Assignee, disclosed in U.S. application Ser. No. 10/294,696 filed Nov. 15, 2002, has an upper portion or dome with four equally positioned and sized indentations, and a body section with vacuum compression panels. As a result of the equally sized and placed indentations, the upper portion of the '696 Application is formed to a single-size grip. That is, the '696 Application is designed for a single hand size. While the indentations provide a secure grip of the upper dome, the upper portion without the indentations is relatively smooth so that a grip on those portions would be less secure, and when the container is filled may result in a spill.

Containers, such as U.S. Pat. No. 5,392,937 to Prevot et. al. and U.S. Pat. No. 5,598,941 to Semersky et. al., employ special grip panels formed so that a person can grip the container. These containers have the advantage of providing relatively easy pourability for certain sizes; however, grip panels are difficult to provide in large size containers. In addition, these known grip panels are provided below the waist of the container and on either side of the container thereby reducing the usual areas on which a label is placed. It is apparent, therefore, that there is a need for a plastic container that provides the ready grippability and pourability afforded by grip-panel containers while providing large label placement areas and that has sufficient strength throughout to provided rigidity and minimize the flex of the container panels under vacuum. All references cited herein are incorporated by reference as if each had been individually incorporated.

BRIEF SUMMARY OF THE INVENTION

In summary, the instant invention is directed to a multi-purpose grip that increases ergonomics/grippability of a container, which accommodate users of various hand sizes and facilitates their ability to pour out the contents of the container without reducing the labeling area of the container. The multi-purpose grip, according to the invention, is formed in the dome of a container and has curved horizontal ribs, which form tiers or steps of the dome, to add rigidity and minimize flex of a panel under vacuum.

This invention is contrary to the teachings of the prior art, in that the container according to the invention uses a stepped dome with modifications to overcome problems associated with known containers.

In addition, the container according to the invention fulfills a long felt need for an easily grippable, large container, and at the same time offers advantages not previously realized by providing multiple sized grips on a single container.

A dome for a container, according to the invention, has a longitudinal axis and includes an upper portion with a flanged finish surrounding the longitudinal axis and adapted to receive a cap where the upper portion extends outwardly and downwardly in a substantially annular fashion from the flanged finish to a first horizontal rib; an intermediate portion extending outwardly and downwardly from under the first horizontal rib of the upper portion to a second horizontal rib; a lower portion extending outwardly and downwardly from under the second horizontal rib to a third horizontal rib where the third horizontal rib is substantially annular; and a grip panel formed within opposite side surfaces of the dome from under the first horizontal rib to above the third horizontal rib, where the opposite grip panels enable a thumb and forefingers of a hand size to grip the container while opposing surfaces of the intermediate and lower portions without the grip panel respectively enable a thumb and forefingers of the hand or another hand size to grip the container in a different manner. That is, one container has at least two different holding grips that allows a user to pick up the container in a secure and comfortable manner without thinking about how one is holding the container.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Figure 1:
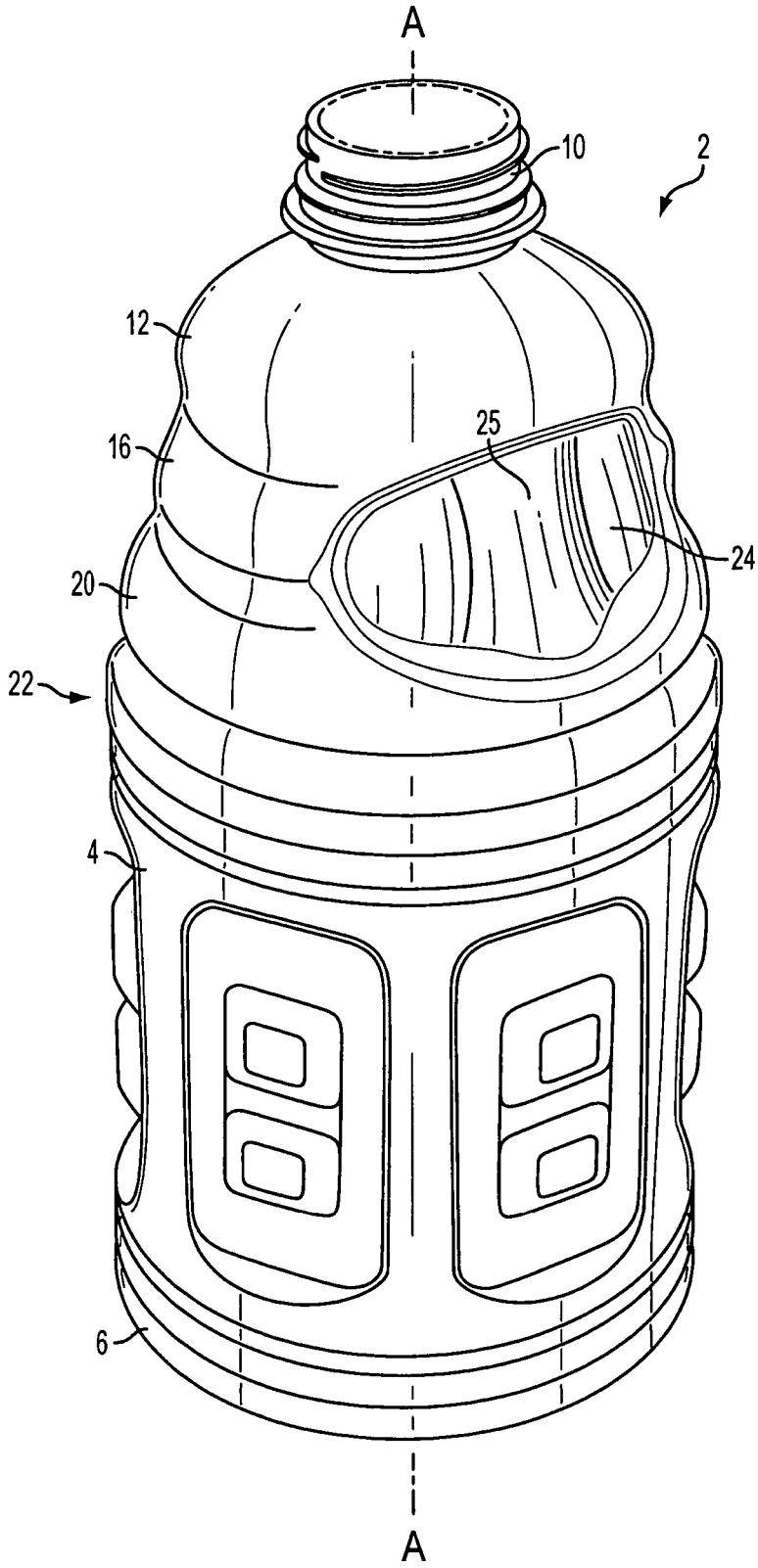
FIG. 1 is a perspective view of an exemplary container that includes a dome according to the present invention.
Figure 2:
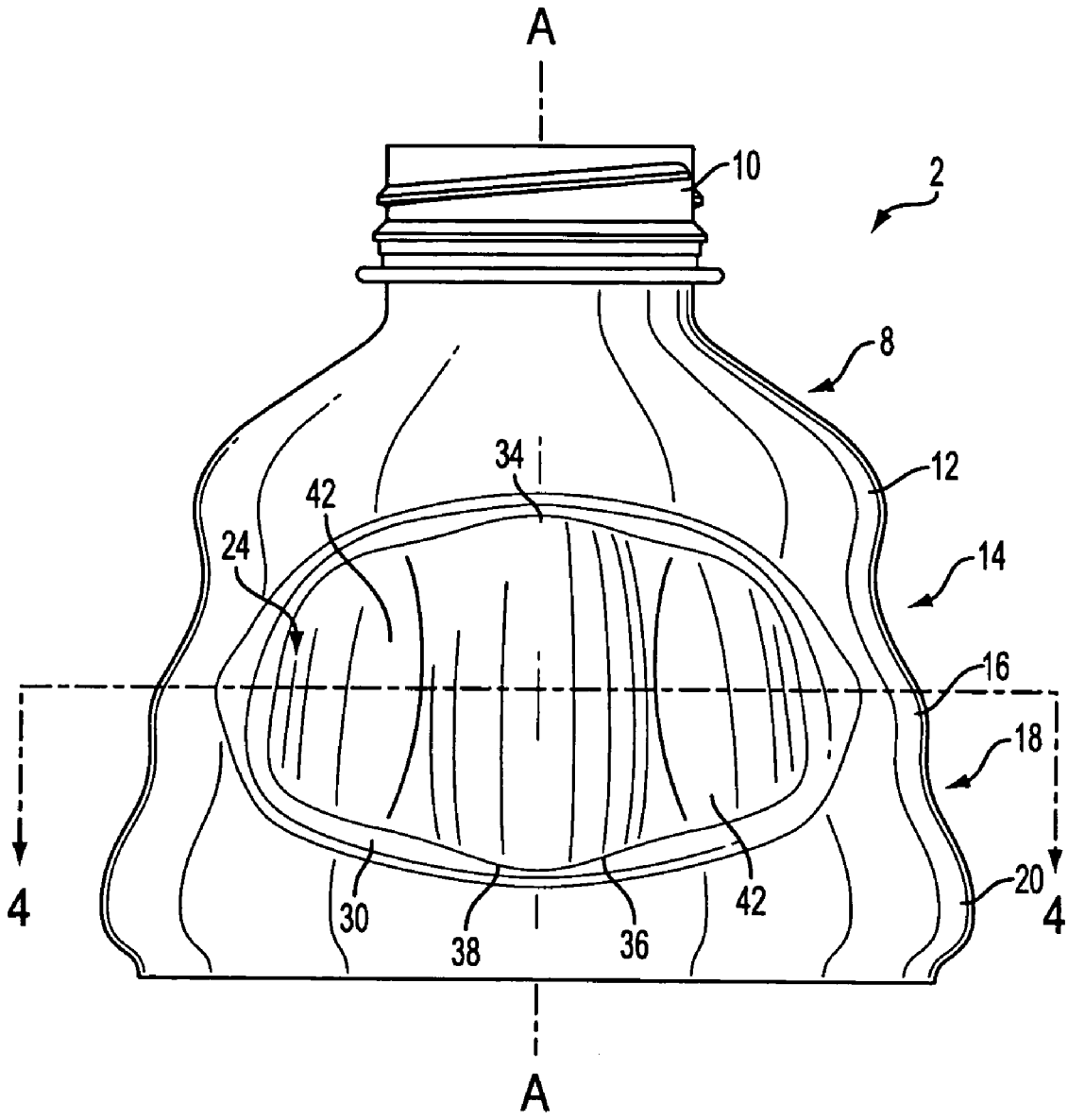
FIG. 2 is a side view of the dome of the exemplary container of FIG. 1.
Figure 3:
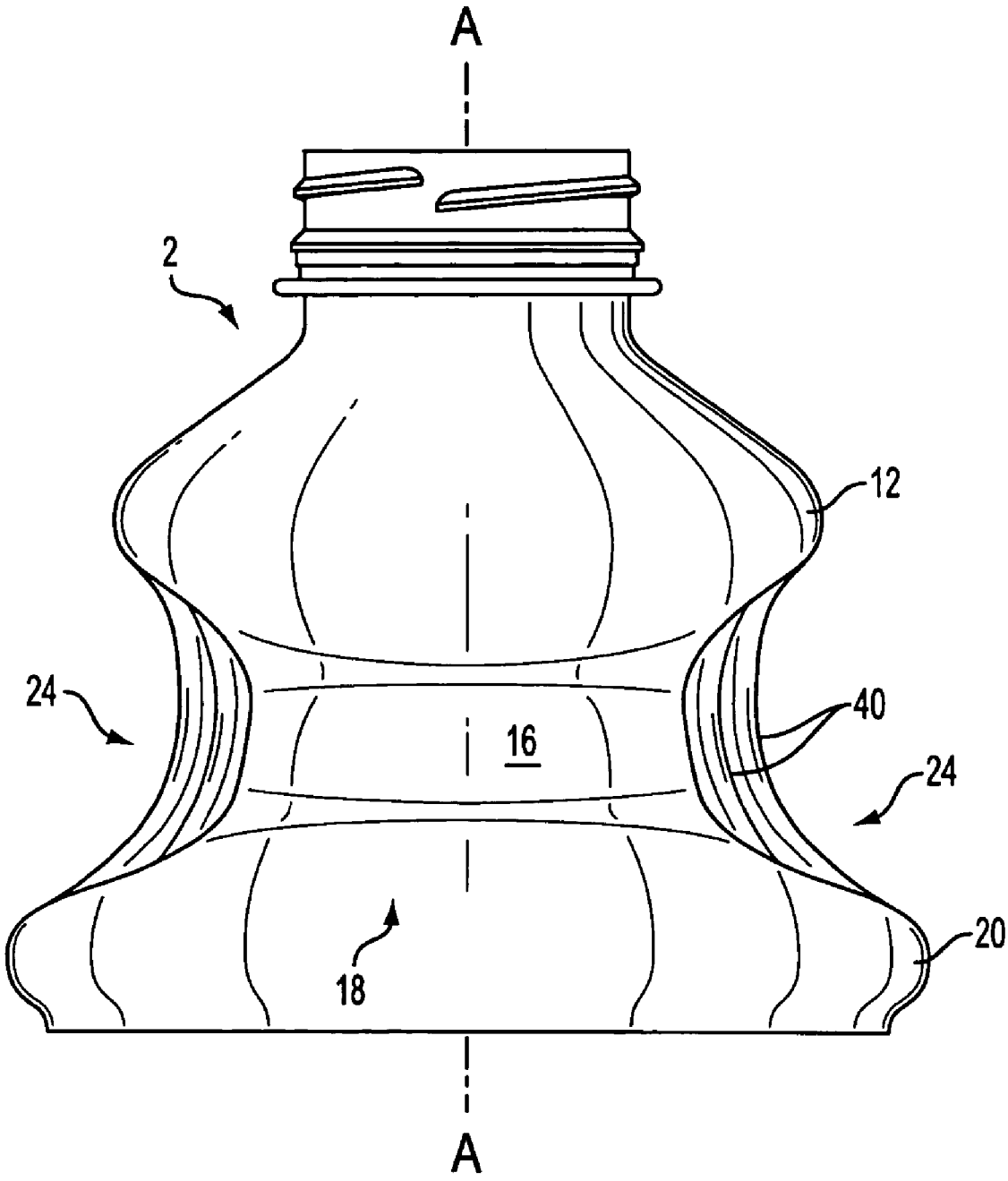
FIG. 3 is another side view of the dome of the exemplary container shown in FIG. 1 taken 90° from the side view of FIG. 2.

Looking at FIG. 1 of the drawings, an exemplary container with a dome according to the invention is shown. The container has a longitudinal axis A extending through the center of the three-dimensional container. Container has a dome section 2, a body section 4, and a base 6. The dome section 2, according to the invention, is shown in FIGS. 2 and 3. The dome section 2 of container has an upper portion 8 with a flanged finish 10, an intermediate portion 14, and a lower portion 18, which together with horizontal ribs 12, 16, 20 at the base of each respective portion form tiers or steps of dome section 2 to add rigidity and minimize flex of a panel under vacuum.

FIGS. 1–7 of the drawings include shade lines illustrating the various subtle curves of dome section 2. Upper portion 8 extends outwardly and downwardly from a base of the flanged finish 10 in a substantially annular fashion to a first horizontal rib 12. An upper side of horizontal rib 12 curves away from longitudinal axis A at a steeper angle than the relatively smooth upper portion 8 to a mid-section of horizontal rib 12 and then curves downwardly and inwardly toward an upper side of intermediate portion 14. That is, the horizontal rib curves around the container and curves about a vertical axis substantially parallel to the longitudinal axis A.

Intermediate portion 14 extends downwardly and outwardly from a bottom side of the inwardly curved horizontal rib 12 to a second horizontal rib 16. The second horizontal rib is curved like the first horizontal rib 12, but it may not be as pronounced as first horizontal rib 12. That is, the second horizontal rib may be shorter in height than first horizontal rib 12. In an exemplary embodiment, intermediate portion 14 extends outwardly and downwardly until it reaches the second horizontal rib 16, which curves outward to a mid-section of horizontal rib 16. Horizontal rib 16 then curves downwardly and inwardly toward the longitudinal axis A of the container where it connects with an upper side of lower portion 18.

Lower portion 18 extends downwardly and outwardly from a bottom side of the inwardly curved horizontal rib 16 to a third horizontal rib 20. The third horizontal rib is curved liked the first and second horizontal ribs 12, 16 but, its contour may bulge outward more than the first and second horizontal ribs 12, 16. That is, the third horizontal rib 20 may be similar in height to that of the first horizontal rib 12 and may be taller in height than horizontal rib 16. In the exemplary embodiment, lower portion 18 extends outwardly and downwardly until it reaches the third horizontal rib 20, which curves outward to a mid-section of horizontal rib 20. The mid-section of horizontal rib 20 may be relatively flat for a distance. Horizontal rib 20 then curves downwardly and inwardly toward the longitudinal axis A of the container where it connects with a waist 22 of the container disposed between body section 4 and dome section 2. The third horizontal rib 20, like the first horizontal rib 12 may be substantially annular in form, as shown in the exemplary embodiments.

A grip panel 24 is formed in opposite side surfaces of dome section 2 extending from first horizontal rib 12 to the third horizontal rib 20. In the exemplary embodiment, grip panel 24 has a central section 25 that is formed under the first horizontal rib 12 and extends to above the third horizontal rib 20. As explained below, on either side of the central section 25, grip panel 24 curves away from either the first horizontal rib 12 or the third horizontal rib 20 and, on either side of grip panel 24, the panel extends from below the first horizontal rib 12 at the intermediate portion 14 to a point above the third horizontal rib 20 in the lower portion 18.

While the illustrated exemplary embodiment employs a grip panel 24 with a central section 25, the Applicants envision a container with a curved contour as the grip area connecting the top horizontal rib to the bottom horizontal rib. The curved contour, grip area may have a single vertical rib located in the center, two vertical ribs and a recessed central portion, or no vertical ribs or ripples. The number of ripples or vertical ribs depends upon the container size and material composition and thus can vary from 0 to any number of ripples. The container grip area may be oval, rectangular, square or other design as long as at least three horizontal ribs form the dome section 2.

Figure 6:
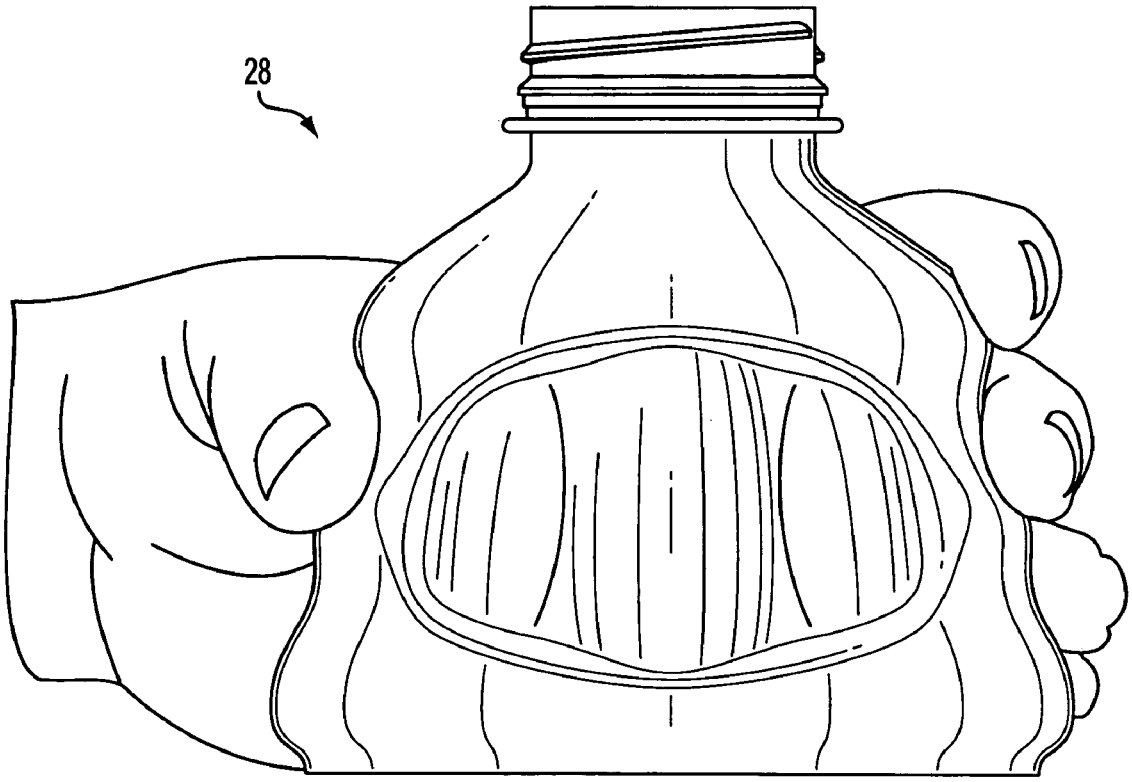
FIG. 6 illustrates the dome according to the invention showing a large hand grasp the dome across the larger grip area in a secure grip.
Figure 7:
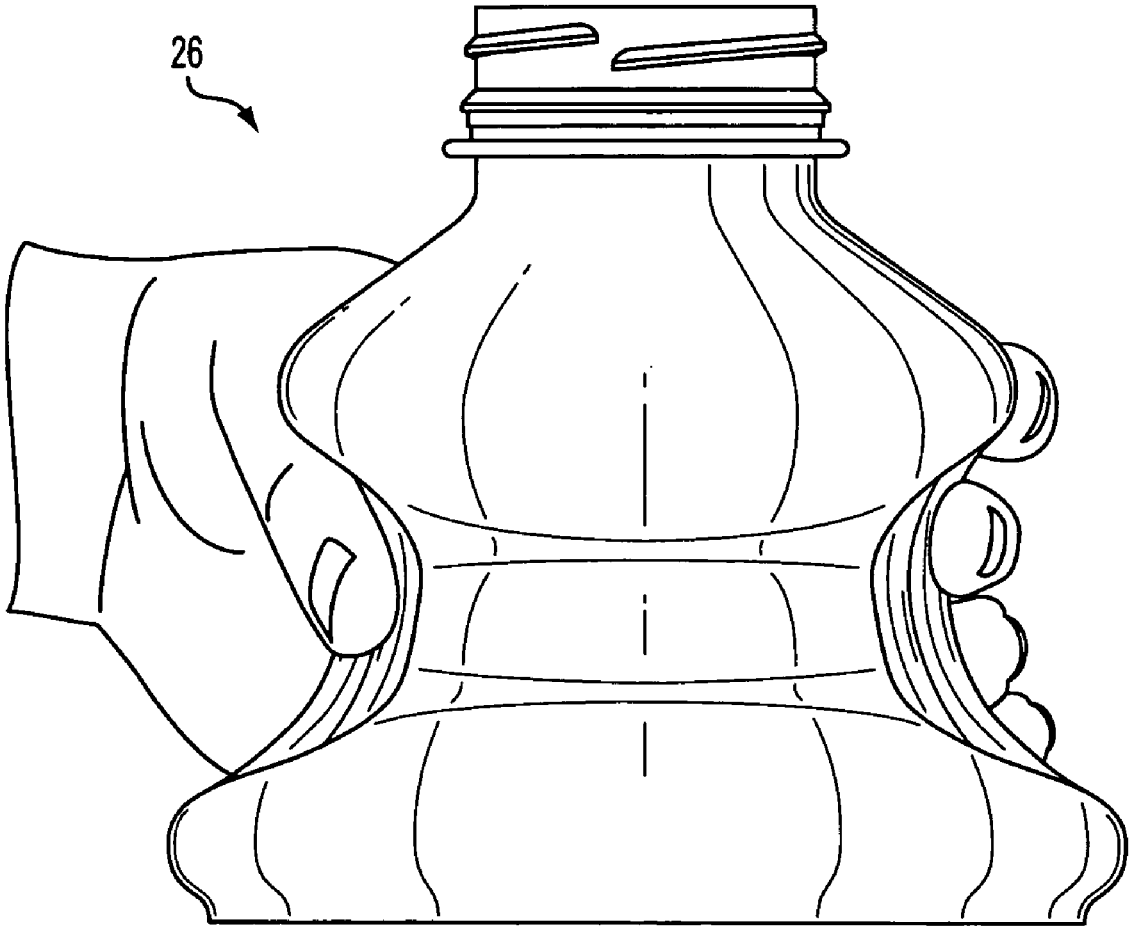
FIG. 7 illustrates the dome according to the invention showing a smaller hand grasp the dome across the smaller grip area in a secure grip.

Grip panel 24 is recessed in opposite side surfaces of dome section 2 and is formed with vertical support, as described below, which adds structure for improved top load performance. FIGS. 6 and 7 clearly illustrate the two different secure grips that can be obtained with the dome section according to the invention. As can be seen from the cross-sectional view of dome section 2 in FIG. 4, grip panels 24 are formed within the dome section resulting in a first grip area 26 where a thumb and forefingers of one hand grasp opposing grip panels 24 and the portion of the hand between the thumb and forefinger spans the unrecessed portion of intermediate section 14, as illustrated in FIG. 7. If dome section 2 is grasped so that the thumb and forefingers of a hand rest in the grooves formed by intermediate portion 14 and lower portion 18 above and below the second horizontal rib 16, a second wider, secure grip area 28 results as shown in FIG. 6. Consequently, the dome section according to the invention may be designed to provide a small grip area 26 for a child's or a small adult's hands and a larger grip area 28 for a larger hand of an adult. Alternatively, a single hand can grip the container with the dome structure in more than one manner so that the user does not have to think about securely holding the container.

Grip panel 24 is formed so that it is recessed into a side surface of dome section 2 and a ribbed area 30 surrounds each grip panel. The ribbed area 30 adds more rigidity to the resultant dome and improves top load. At its widest horizontal point, ribbed area 30 of grip panel 24 is substantially parallel to longitudinal axis A of container 1. This provides strength to the recessed grip panel 24. A second horizontal rib 16 is disposed on either side of recessed grip panel 24. Grip panel 24, at its widest point, extends from one second horizontal rib 16 to the other second horizontal rib 16. The contour of grip panel 24 rounds upwards toward first horizontal rib 12 in an upper curve. Approximately in the middle of grip panel 24, an upper parabolic curve 34 extends into first horizontal rib 12 from the upper curve on the left-hand side and downward on the right-hand side. In a similar fashion, the contour of grip panel 24 rounds downward on either side toward third horizontal rib 20 in a lower curve 36. Another parabolic curve 38 extends into third horizontal rib 20 substantially underneath parabolic curve 34. Lower parabolic curve 38 may be more pronounced than the upper parabolic curve 34.

The center horizontal rib 16 prevents ovalization of the dome of the container. Ovalization occurs in a plastic container when the container is filled with a hot-product and then cooled. The cooling process produces a vacuum within the container that pulls the plastic walls of the grip area 24 closer to axis A. As a result of the center horizontal rib, the dome of the container with the curved contour grip area cannot be pulled in any further to axis A thereby preventing ovalization. Further, the horizontal ribs of the dome section 2 strengthen the plastic container when filled with a hot product. While the results of stacking empty plastic containers according to the invention or top loading the container were not as high as desired, the combination of the vacuum produced after hot-filling the container and the horizontal ribs significantly improved the top-loading of the containers according to the invention. Testing showed that after hot-filling a container according to the invention, the top loading was significantly improved from approximately 45%–65% on average.

Figure 4:
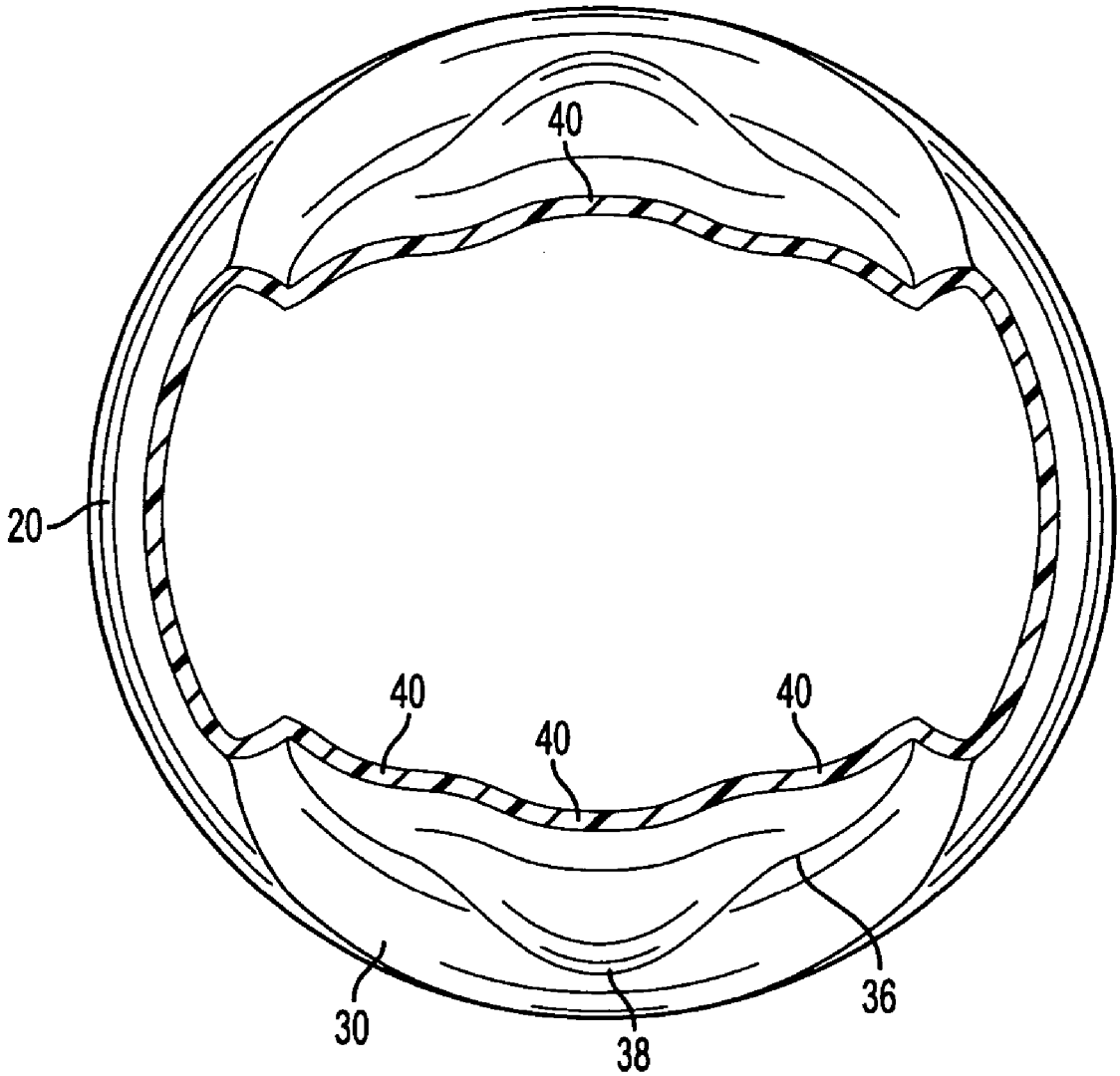
FIG. 4 is a cross-sectional view of the dome of FIG. 2 taken along line 4—4.
Figure 5:
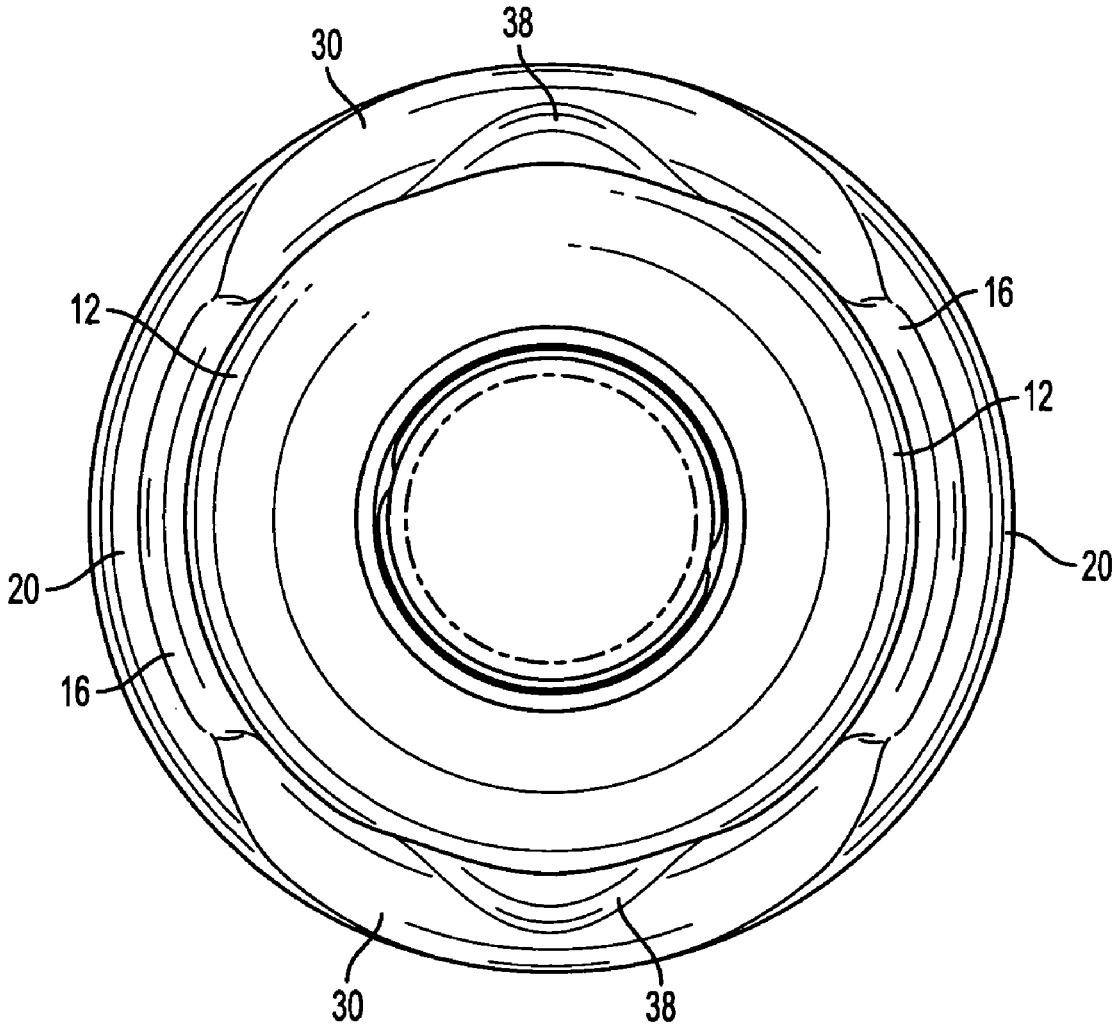
FIG. 5 is a top view of the dome of FIG. 2.

As shown in the exemplary embodiment of FIGS. 3–4, each grip panel 24 includes at least one vertical rib 40 curving inwardly toward longitudinal axis A from third horizontal rib 20 to a point of vertical rib 40 and then curves outwardly from longitudinal axis A to first horizontal rib 12. According to the invention, the grip area should have a compound curvature with either no vertical ribs or a plurality of vertical ribs, as described above. While three vertical ribs are shown in the exemplary embodiment, as many vertical ribs that may fit in the grip area may be used. Three vertical, rippled ribs 40 are used in the exemplary embodiment to add structure for improved top load performance and gripability. As shown in the cross-sectional view of FIG. 4 and by the shade lines of FIGS. 1 and 2, the center vertical rib 40 is more pronounced than the two vertical ribs 40 on either side of the center vertical rib. However, according to the invention, no vertical rib needs to be more prominent than another vertical rib. In the exemplary embodiment, central vertical rib 40 protrudes out of grip panel 24 and has a transverse curve from the left-side to the right side of central vertical rib 40. The transverse curve of the central vertical rib 40 begins curving away from an unrippled surface of the grip panel 24 about the same location as the beginning of a parabolic curve 34, 38. The vertical rib 40 reaches it highest level from the grip panel unrippled surface at approximately the "peak" of each parabolic curve. However, all vertical ribs 40, in the exemplary embodiment, are less prominent than ribbed area 30 that surrounds each grip panel 24.

As indicated by the shade lines of FIGS. 1 and 2 and the cross-section of dome section 2 in FIG. 4, the two outer vertical ribs 40 are more subtle ripples than the prominent protrusion formed by the central vertical rib 40, which includes parabolic curves 34, 38. As shown in FIGS. 2 and 4, the three exemplary vertical ribs 40 form dimples or recesses 42 on either side of the exemplary ribs 40. It is envisioned that a single vertical rib 40 may provide sufficient structure so that dome section 2 does not collapse when a number of containers are stacked on top of the container according to the invention. As mentioned above, if there is a single vertical rib 40, dimples or recesses 42 preferably would be formed on either side thereof. As a result, a person grasping the filled container according to the invention would feel a secure grip when their thumb and forefinger rests in one of grooves or recesses 42. Thus, grip area 26 for a child's or small adult's hand has dimples or recesses 42 so that the person (customer) feels the secure grip obtained in that area, while the recesses between horizontal ribs 12,16, 20 provide a secure grip feeling in grip area 28 for a larger adult hand.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A dome for a plastic container having a longitudinal axis, comprising:

an upper portion with a flanged finish adapted to receive a cap, said upper portion extending substantially annular about the axis from the flanged finish to a first horizontal rib;

an intermediate portion extending outwardly from under the first horizontal rib of the upper portion to a second horizontal rib;

a lower portion extending outwardly from under the second horizontal rib to a third horizontal rib, said third horizontal rib being substantially annular; and a grip panel formed in opposite side surfaces from under the first horizontal rib to above the third horizontal rib, where the opposing grip panels form at least two different sized grip areas that enable a thumb and forefingers of a hand size to grip the container while opposing surfaces of the intermediate and lower portions without the grip panel enable a thumb and forefingers of another hand size to grip the container.

2. A dome for a container according to claim 1, wherein each grip panel is recessed into a side surface of the dome and a ribbed area surrounds each grip panel.

3. The dome according to claim 2, wherein the grip panel in the vicinity of its widest point extends from a portion of the second, horizontal rib upwards in a curved fashion to under the first horizontal rib and downwards in a curved fashion to another portion of the second, horizontal rib.

4. The dome according to claim 2, wherein each grip panel further includes at least one vertical rib that curves inwardly from the first horizontal rib to an approximate mid-section of the grip panel and then curves outwardly to the third horizontal rib.

5. The dome according to claim 4, wherein a groove is formed on opposite sides of the at least one vertical rib that is formed in the approximate center of the grip panel so that an upper portion of a thumb and forefingers of a user can grip the dome of the container.

6. The dome according to claim 2, wherein the grip panel in the vicinity of its widest point extends from a portion of the second, horizontal rib downwardly in a curved fashion to the third horizontal rib and upwards in a curved fashion to another portion of the second, horizontal rib.

7. The dome according to claim 2, wherein each grip panel further includes at least one vertical rib extending in a curve from above the third horizontal rib to under the first horizontal rib.

8. The dome according to claim 7, wherein the at least one vertical rib is less prominent than the ribbed area surrounding each grip panel.

9. The dome according to claim 7, wherein each grip panel includes three vertical ribs that are spaced across each grip panel and the central vertical rib is more prominent than the two remaining vertical ribs.

10. A dome for a container according to claim 7, wherein each grip panel includes two or more vertical ribs that are spaced across each grip panel and the two or more vertical ribs have approximately the same contour.

11. The dome according to claim 7, wherein the at least one vertical rib adds sufficient structure to improve top load performance and gripability.

12. A dome for a container according to claim 1, wherein each grip panel is a compound curvature.

13. The dome according to claim 1, wherein the first horizontal rib bows out at the bottom of the upper portion and then curves inwardly toward the longitudinal axis of the dome.

14. The dome according to claim 13, wherein the second horizontal rib bows outward at the bottom of the intermediate portion and then curves inwardly toward the longitudinal axis of the dome.

15. The dome according to claim 14, wherein the lower portion extends outwardly from the axis of the dome and ends at the third horizontal rib which bows out before curving inwards toward the axis of the dome.

16. The dome according to claim 1, wherein the opposing surfaces of the upper, intermediate and lower portions without the grip panel incorporate curved first, second and third horizontal ribs to add rigidity, prevent ovalization and to minimize the flex of the dome under vacuum.

17. A dome for a plastic container having a longitudinal axis, comprising:

an upper portion with a flanged finish adapted to receive a cap, said upper portion extending substantially annular about the axis from the flanged finish to a first horizontal rib;

an intermediate portion extending outwardly from under the first horizontal rib of the upper portion to a second horizontal rib;

a lower portion extending outwardly from under the second horizontal rib to a third horizontal rib, said third horizontal rib being substantially annular; and a grip panel formed in opposite side surfaces from under the first horizontal rib to above the third horizontal rib so that two opposing sections of the second horizontal rib extend between the opposing grip panels, where the opposing grip panels enable a thumb and forefingers of a hand size to grip the container while the intermediate portion and the lower portion without the grip panel respectively enable a thumb and forefingers of another hand size to grip the container.

18. A dome for a container according to claim 17, wherein each grip panel is a compound curvature.

19. A dome for a container according to claim 17, wherein each grip panel is recessed into a side surface of the dome and a ribbed area surrounds each grip panel, said grip panel being curved around the axis of the dome and curved inwardly toward the longitudinal axis of the dome from the first horizontal rib to a mid-section of the grip panel and then curved outwardly to the third horizontal rib.

20. The dome according to claim 17, wherein each grip panel further includes at least one vertical rib extending in a curve from the third horizontal rib to the first horizontal rib.

21. The dome according to claim 20, wherein the at least one vertical rib adds sufficient structure to improve top load performance and gripability.

22. The dome according to claim 17, wherein the opposing surfaces of the upper, intermediate and lower portions without the grip panel incorporate curved first, second and third horizontal ribs to add rigidity, prevents ovalization and to minimize the flex of the dome under vacuum.

23. The dome according to claim 22, wherein a vacuum induced in a hot-filled container together with the curved first, second and third horizontal ribs significantly strengthens the container and top load performance of the container.

* * * * *